US006964931B2

(12) United States Patent
Carlyle et al.

(10) Patent No.: US 6,964,931 B2
(45) Date of Patent: Nov. 15, 2005

(54) METHOD OF MAKING CONTINUOUS FILAMENT WEB WITH STATISTICAL FILAMENT DISTRIBUTION

(75) Inventors: Thomas Scott Carlyle, Huntersville, NC (US); Marlene Storzer, Cornelius, NC (US)

(73) Assignee: Polymer Group, Inc., North Charleston, SC (US)

( * ) Notice: Subject to any disclaimer, the term of this patent is extended or adjusted under 35 U.S.C. 154(b) by 219 days.

(21) Appl. No.: 09/793,360

(22) Filed: Feb. 26, 2001

(65) Prior Publication Data

US 2002/0094741 A1 Jul. 18, 2002

Related U.S. Application Data

(60) Provisional application No. 60/186,841, filed on Mar. 3, 2000.

(51) Int. Cl.[7] ..... D04H 1/00; D04H 13/00

(52) U.S. Cl. ..... 442/340; 442/341; 442/344; 442/361; 442/362; 442/363; 442/364; 442/365; 442/401; 442/409; 442/411; 442/415

(58) Field of Search ..... 264/172.11, 176.1, 264/177.13, 209; 442/340, 341, 344, 361–365, 401, 409, 411, 415

(56) References Cited

U.S. PATENT DOCUMENTS

| | | | | |
|---|---|---|---|---|
| 3,692,618 A | | 9/1972 | Dorschner et al. | |
| 3,802,817 A | | 4/1974 | Matsuki et al. | |
| 4,064,605 A | | 12/1977 | Akiyama et al. | |
| 4,189,338 A | | 2/1980 | Ejima et al. | |
| 4,340,563 A | | 7/1982 | Appel et al. | |
| 4,405,297 A | | 9/1983 | Appel et al. | |
| 4,469,540 A | | 9/1984 | Furukawa et al. | |
| 4,668,566 A | | 5/1987 | Braun | |
| 4,738,607 A | | 4/1988 | Nakajima et al. | |
| 4,874,666 A | | 10/1989 | Kubo et al. | |
| 4,981,749 A | | 1/1991 | Kubo et al. | |
| 5,068,141 A | | 11/1991 | Kubo et al. | |
| 5,336,552 A | | 8/1994 | Strack et al. | |
| 5,382,400 A | | 1/1995 | Pike et al. | |
| 5,418,045 A | | 5/1995 | Pike et al. | |
| 5,466,410 A | * | 11/1995 | Hills | 264/172.11 |
| 5,482,772 A | * | 1/1996 | Strack et al. | 428/357 |
| 5,512,358 A | | 4/1996 | Shawver et al. | |
| 5,551,588 A | | 9/1996 | Hills | |
| 5,556,589 A | | 9/1996 | Sibal | |
| 5,575,063 A | | 11/1996 | Hodan et al. | |
| 5,605,739 A | * | 2/1997 | Stokes et al. | 428/198 |
| 5,620,644 A | | 4/1997 | Hodan et al. | |
| 5,814,178 A | * | 9/1998 | Jacobs | 156/290 |
| 5,858,504 A | * | 1/1999 | Fitting | 428/131 |
| 6,312,545 B1 | * | 11/2001 | Nickel et al. | 156/229 |

* cited by examiner

*Primary Examiner*—Glenn Caldarola
*Assistant Examiner*—Alexis Wachtel
(74) *Attorney, Agent, or Firm*—Wood, Phillips, Katz, Clark & Mortimer

(57) ABSTRACT

The present invention is directed to a method of making a substantially continuous filament web which includes providing a plurality of polymer extruders for supplying polymer streams of at least two different polymer compositions, and providing a spinneret assembly for receiving the polymer streams. The spinneret assembly includes a plurality of orifices from which the polymer streams are extruded for formation of substantially continuous filaments formed from the polymer compositions. The distribution of at least one of the polymer compositions within the spinneret assembly is selected to optimize selected physical characteristics of the resultant continuous filament web.

9 Claims, 4 Drawing Sheets

Filament Profiles

METHOD OF MAKING CONTINUOUS FILAMENT WEB WITH STATISTICAL FILAMENT DISTRIBUTION

CROSS-REFERENCE TO RELATED APPLICATION

This application claims the benefit of Provisional Application Ser. No. 60/186,841, filed Mar. 3, 2000.

TECHNICAL FIELD

The present invention relates generally to a method for making a spunbond filament web, and more particularly to a method of making a spunbond filament web, and nonwoven fabrics therefrom, wherein the web comprises a statistical distribution of one or more homopolymer monofilaments, and one or more multi-component filaments to provide the web and resultant nonwoven fabrics with engineered physical characteristics as may be required for specific applications.

BACKGROUND OF THE INVENTION

Nonwoven fabrics are used in a wide variety of applications where the engineered qualities of the fabrics can be advantageously employed. These types of fabrics differ from traditional woven or knitted fabrics in that the fibers or filaments of the fabric are integrated into a coherent web without traditional textile processes.

Filaments or fibers from which nonwoven fabrics are formed are frequently formed by spunbonding processes. In these processes, a thermoplastic polymer is melted and extruded, or "spun", through a large number of small orifices to produce a bundle of continuous or essentially endless filaments. These filaments are cooled and drawn or attenuated and are deposited as a loose web onto a moving conveyor. The filaments are then partially bonded, such as by passing the web between a pair of heated rolls, with at least one of the rolls having a raised pattern to provide a bonding pattern in the fabric. The web of filaments can also be bonded by through-air bonding, as is known in the art.

Spunbond technology is well established in the field of nonwoven fabric production. While many advancements in the technology have been discovered, essential elements remain as described in early patents, which disclose use of a Venturi tube drawing system, including U.S. Pat. No. 3,692,618, No. 3,802,817, and No. 4,064,605, all of which are hereby incorporated by reference. As described in the basic process, a polymer, preferably a thermoplastic polymer, is melted and mixed in a extruder, with a molten polymer stream then fed, under pressure, to a spinneret assembly having a flat, machined plate defining hundreds, or thousands, of orifice openings. The polymer is forced through these openings, and emerges as a still molten, fine polymer stream. It is necessary to apply a force to the polymer stream as it cools into a filament, with such force being referred to as a drawing force. In the above-referenced patents, a Venturi tube system is used for drawing the filaments. This process requires that the multi-filament curtain of filaments be divided (usually by hand) into bundles that are fed into the mouth of a long tube, sometimes referred to as an accelerator gun. High velocity air moving through the tube accelerates the filaments, providing a positive draft relative to the speed of the filament at the spinneret face and at the point of quenching of the filament some inches below the spinneret face.

There are other techniques for providing this drawing step. It is known in the art to use Godet rolls which provide a mechanical drawing force to the extruded filaments by passing the filaments in bundles around a series of smooth metal rolls which operate at progressively increasing surface speeds. U.S. Pat. No. 4,340,563 and No. 4,405,297 describe a further advancement in the drawing of spunbond filaments, referred to as "slot draw". In these processes, the series of drawing guns or tubes are replaced by a full-width slot which receives the entire filament curtain and maintains it. Draw tension is still provided by accelerating air, but the overall process is significantly less aggressive than the guns or Godet rolls, providing fewer processing problems as can result from filament breaks associated with other drawing methods.

The spinning of bi-component or multi-component spunbond filaments is also known in the art. U.S. Pat. No. 4,189,338 discloses a process for production of nonwoven fabric of filaments comprising polypropylene and low crystallinity polypropylene in a side-by-side configuration. U.S. Pat. No. 4,469,450 discloses bi-component filaments of polyester and polypropylene, arranged in either a side-by-side configuration, or a sheath-core configuration. U.S. Pat. No. 4,874,666 discloses a bi-component fiber with a polyester core, while U.S. Pat. No. 4,981,749 and No. 5,068,141 disclose sheath-core filaments of linear low density polyethylene and polyethylene terephthalate (PET).

Further development of bi-component (or conjugate) spinning has recognized the desirability of combining low and high melting point filaments in a fabric, such as is disclosed in U.S. Pat. No. 4,668,566, which relates to the use of a multi-beam spinning process for providing alternating polyester and polypropylene spunbond layers. U.S. Pat. No. 5,336,552 relates to a blend of olefin polymer and ethylene alkyl acrylate on one side or in the sheath, with polypropylene as the other filament component. U.S. Pat. No. 5,382,400 and No. 5,418,045 relate to the development of latent crimp in bi-component spunbond fibers. U.S. Pat. No. 5,482,772 and No. 5,512,358 relate to the formation of filaments from olefins, preferably polypropylene, with some minor polymer such as heterophasic polypropylene and butene.

Various types of apparatus for production of bi-component filaments and fibers are known in the art. U.S. Pat. No. 5,620,644 and No. 5,575,063 relate to the design of a spin pack for the melt spinning of two liquid polymer streams to produce bi-component filaments. U.S. Pat. No. 5,556,589 relates to a polymer distribution assembly and spinneret design for production of sheath-core bi-component filaments. U.S. Pat. No. 5,551,588 and No. 5,466,410, both hereby incorporated by reference, relate to a spinneret design for the production of multi-component filaments, in particular, filaments which are non-circular in cross-section, and have irregular polymer distribution. Notably, these patents disclose formation of spinneret assemblies through photo-engraving techniques, whereby the spinneret assemblies can be economically manufactured. Arrangements for diverting twin streams of dissimilar liquid phase polymers into a bi-component spinneret are known in the art, such as exemplified by U.S. Pat. No. 4,738,607, which discloses a conjugate spinning assembly having a distribution plate above the spinneret.

SUMMARY OF THE INVENTION

The present invention relates to a method for providing a distributed or zoned placement of filaments of different homopolymer filaments or homopolymer and bi or multi-component filaments in a spunbond process for producing a continuous filament web, and for producing nonwoven fabrics therefrom. The method contemplates distributing or zoning of two or more different homopolymer filaments and/or bi-component or multi-component filaments. By statistically distributing filament structures within the web, the web characteristics can be specifically engineered. By distributing and/or zoning hompolymer filaments of a lower melting point polymer with those of a higher melting point, the web cohesion, strengths, elongations, and hand, can be specifically engineered for the desired application. By distributing and/or zoning bi-component filaments with homo-component filaments, attributes such as web cohesion, strength, elongations, hand, pore size, surface area, etc. of the final web can be engineered as desired.

While it is known in the prior art to provide alternate layers of spunbond filaments in a multi-beam process where certain of the layers contain bi-component filaments, and other layers contain homopolymer filaments, the process of the present invention considers the simultaneous formation of both bi-component and/or multi-component filaments and homopolymer filaments from a single spinneret. The present invention further contemplates the advantages of selective location of the homopolymer filaments relative to the mixed component filaments in the filament curtain. Such placement can be described as controlled or statistical distribution, with concentrated zones of mixed component fibers as an example.

In accordance with the present invention, a method of making a substantially continuous filament web comprises the steps of providing a plurality of polymer extruders for supplying polymer streams of at least two different polymer compositions. In the preferred practice of the present invention, the polymer compositions have differing melting points. The present method further contemplates providing a spinneret assembly for receiving the polymer streams, with the spinneret assembly including a plurality of orifices from which the polymer streams are extruded for formation of substantially continuous filaments formed from the polymer compositions. In the preferred form, the present method further contemplates thermal bonding of the substantially continuous filaments to form the continuous filament web, wherein the distribution of at least one of the polymer compositions within the spinneret is selected to optimize selected characteristics of the resultant web.

If the continuous filament web is thermally bonded, the thermal bonding step may comprise thermal point bond calendering. Thermal bonding of the web can also be effected by way of through-air bonding.

Formation of the filaments in accordance with the present invention includes forming at least some of the filaments as bi-component filaments, each including at least two of the polymer compositions employed in the process. Other ones of the filaments are formed from a single one of the polymer compositions. The bi-component filaments may comprise sheath-core bi-component filaments, segmented pie bi-component filaments, and/or side-by-side bi-component filaments. Formation of filaments wherein at least some of the filaments are hollow bi-component filaments is further contemplated.

The present invention was developed as an alternative to current spunbonding processes, such as spunbonding of polyester filament webs. Such current processes typically result in webs having relatively low tensile strengths and high shrinkage. Accordingly, the use of a binder filament, and alternative bonding methods have been investigated. Additionally, it is believed that by employing bi-component splitting technologies, the webs and resultant nonwoven fabrics can be further engineered as may be required. For example, it is contemplated that specific zoning of hydrophilic or hydrophobic regions can be achieved.

While thermal bonding of the continuous filament webs formed in accordance with the present invention is presently contemplated, it is within the purview of the present invention to employ alternative bonding techniques, including hydroentanglement, addition of binder compositions, needle punching, and other bonding techniques as are known in the art.

DETAILED DESCRIPTION

Figure 1:
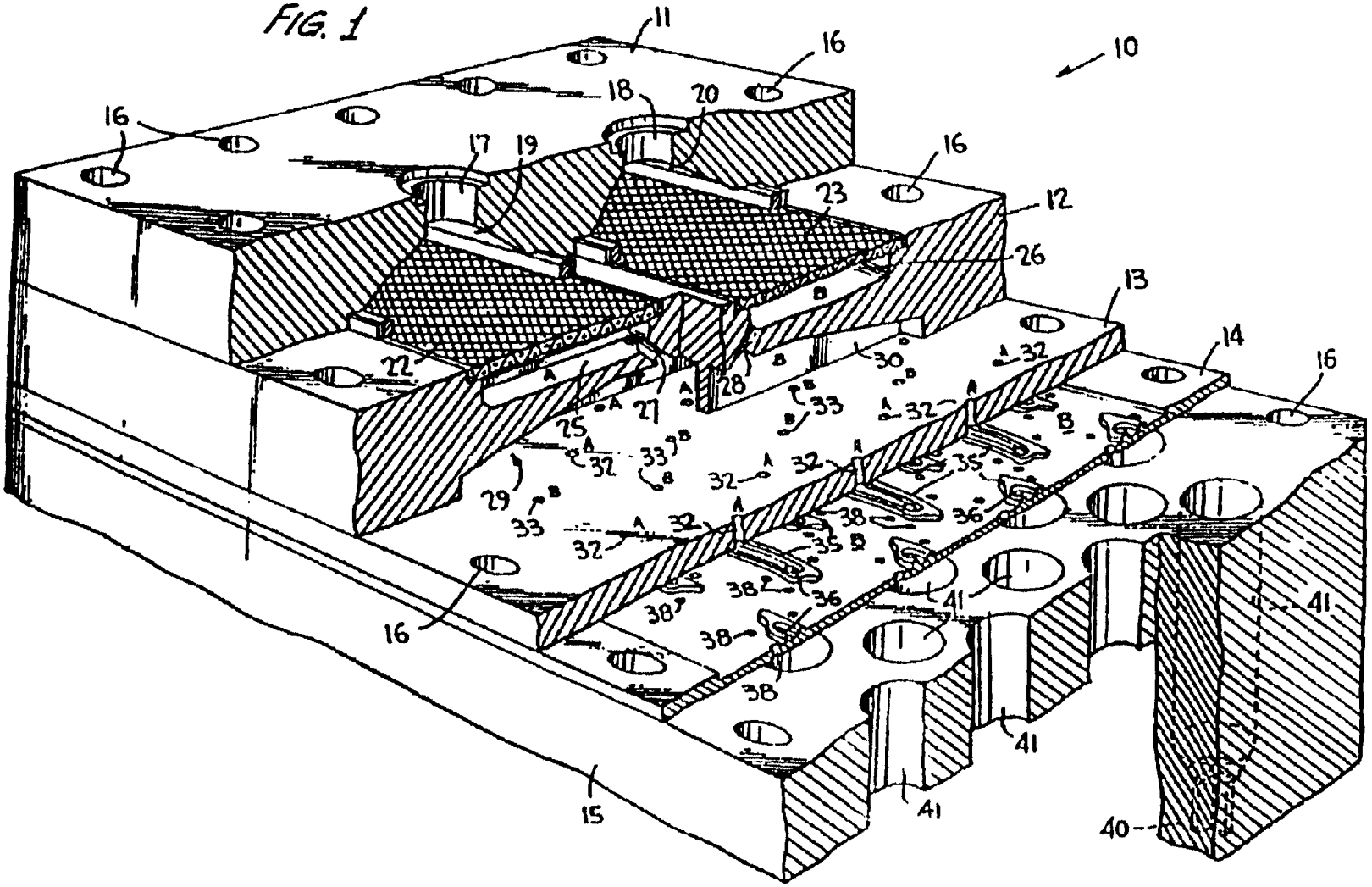
FIG. 1 is a cut-away perspective view of a spinneret assembly.

While the present invention is susceptible of embodiment in various forms, there is shown in the drawings and will hereinafter be described, presently preferred embodiments, with the understanding that the present disclosure is to be considered as an exemplification of the invention, and is not intended to limit the invention to the specific embodiments illustrated.

The present invention contemplates a method of producing a melt-spun substantially continuous filament web, and nonwoven fabrics from the web. The process of the present invention contemplates the simultaneous formation of filaments from more than one type of homopolymer or blend of homopolymers from a single spinneret or both bi-component or multi-component filaments and homopolymer filaments from a single spinneret. By selective location of homopolymer filaments relative to each other or to the mixed component filaments in the filament curtain, the physical characteristics of the resultant web can be selectively engineered. This placement can be described as controlled or statistical distribution.

The present invention contemplates use of multiple polymer extruders, and certain known production techniques for production of filaments with discrete placement of two or more polymeric components, i.e., so-called bi-component or multi-component filaments. In the present invention, the spinneret assembly design permits the extrusion of both homopolymer filaments and mixed component filaments from the same spinneret. It is possible to change the distribution of the filaments with a single spinneret design by changing the polymer feed to the various extruders. Maximum flexibility of the design is achieved with multiple spinnerets that are interchangeable in the die assembly.

Homopolymer filaments may be produced from any thermoplastic polymer, such as polyolefins, polyester, polyamides, as well as copolymers and terpolymers of the same. The mixed component filaments may be produced in a variety of geometric configurations, including sheath-core, side-by-side, eccentric sheath-core, segmented pie, and hollow segmented pie. Suitable polymers for these filaments are generally polyolefin-polyester, polyolefin-polyamide, polyolefin-polyolefin, although exhibits such as co-polyester-polyester are also contemplated.

The present invention also contemplates the use of polymer blends in place of the homopolymer, copolymer, or terpolymer. There are certain known advantages in the production of blended polymer filaments, such as described in European Patent No. 843753. Such advantages can be further utilized to enhance nonwoven fabric properties of fabrics formed in accordance with the present invention.

Filaments may be produced in deniers from 1.0 to 4.5, with 1.5 to 3.5 being most preferred. The resulting fabrics are produced in a basis weight range of 5 to 500 grams per square meter. Basis weight ranges above 50 grams per square meter are economically formed by employing multiple filament beams in an in-line process.

The types of distribution of filaments contemplated by the present invention include ratios of 5/95% homofilament/mixed component filaments to 95/5% homofilament/mixed component filaments. In accordance with the present invention, zoned placement of the mixed component fibers includes, but is not limited to: all peripheral placement; all interior in a rectangular, oval, or ellipse; and stripes, either lateral or longitudinal. These preferred zonal placements are in contrast to other possible arrangements, such as "unbalanced" placement, that is, formation such that most of the mixed component filaments would be present more in one section of the spinneret than another. In addition to zoned placement which is described above, the present invention contemplates the advantages of fully dispersed placement of mixed component filaments across the full matrix of the spinneret orifices.

Figure 2A:
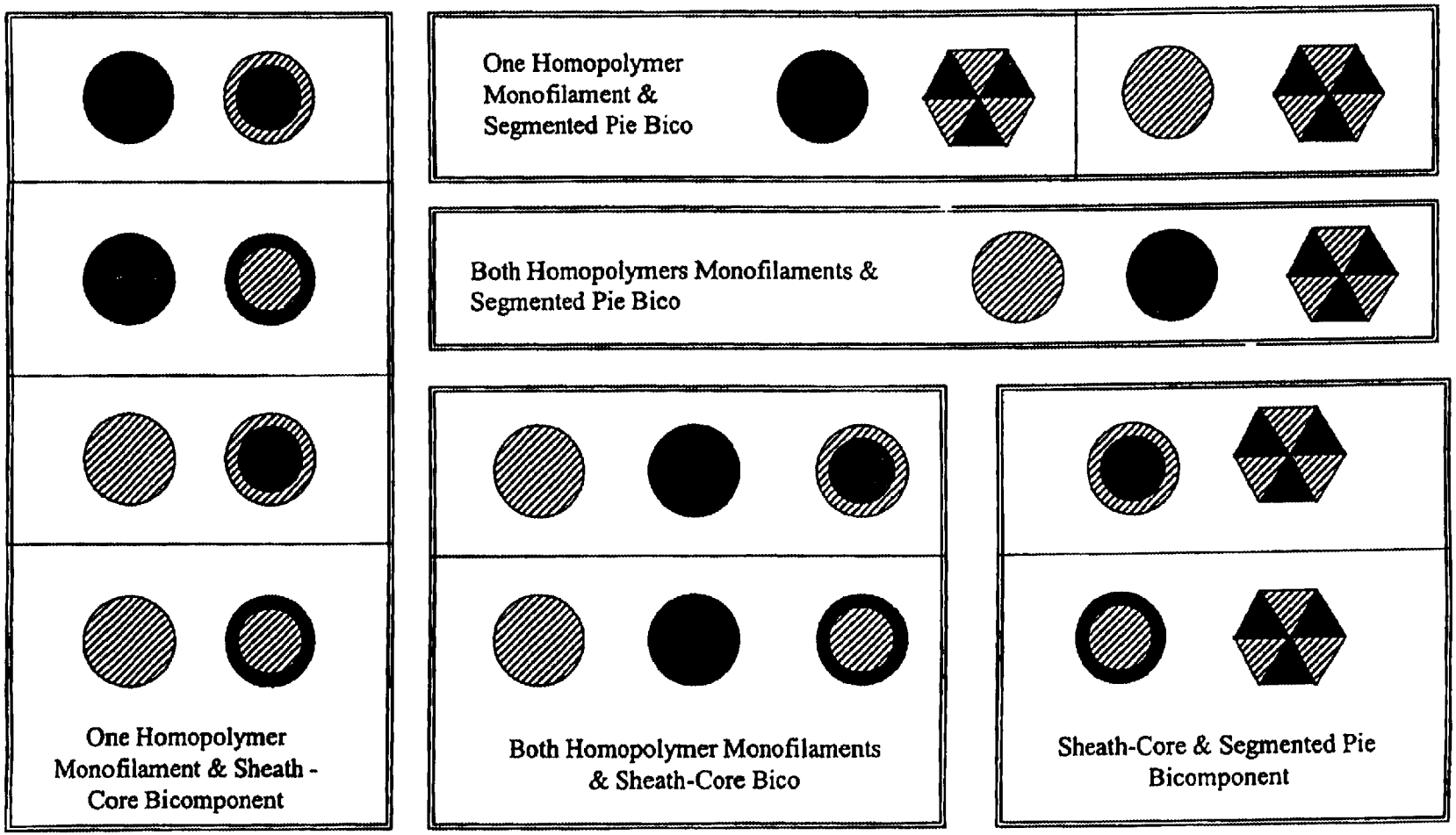
FIGS. 2*a*, 2*b*, and 2*c* illustrate various filament profiles contemplated by the present invention.
Figure 2B:
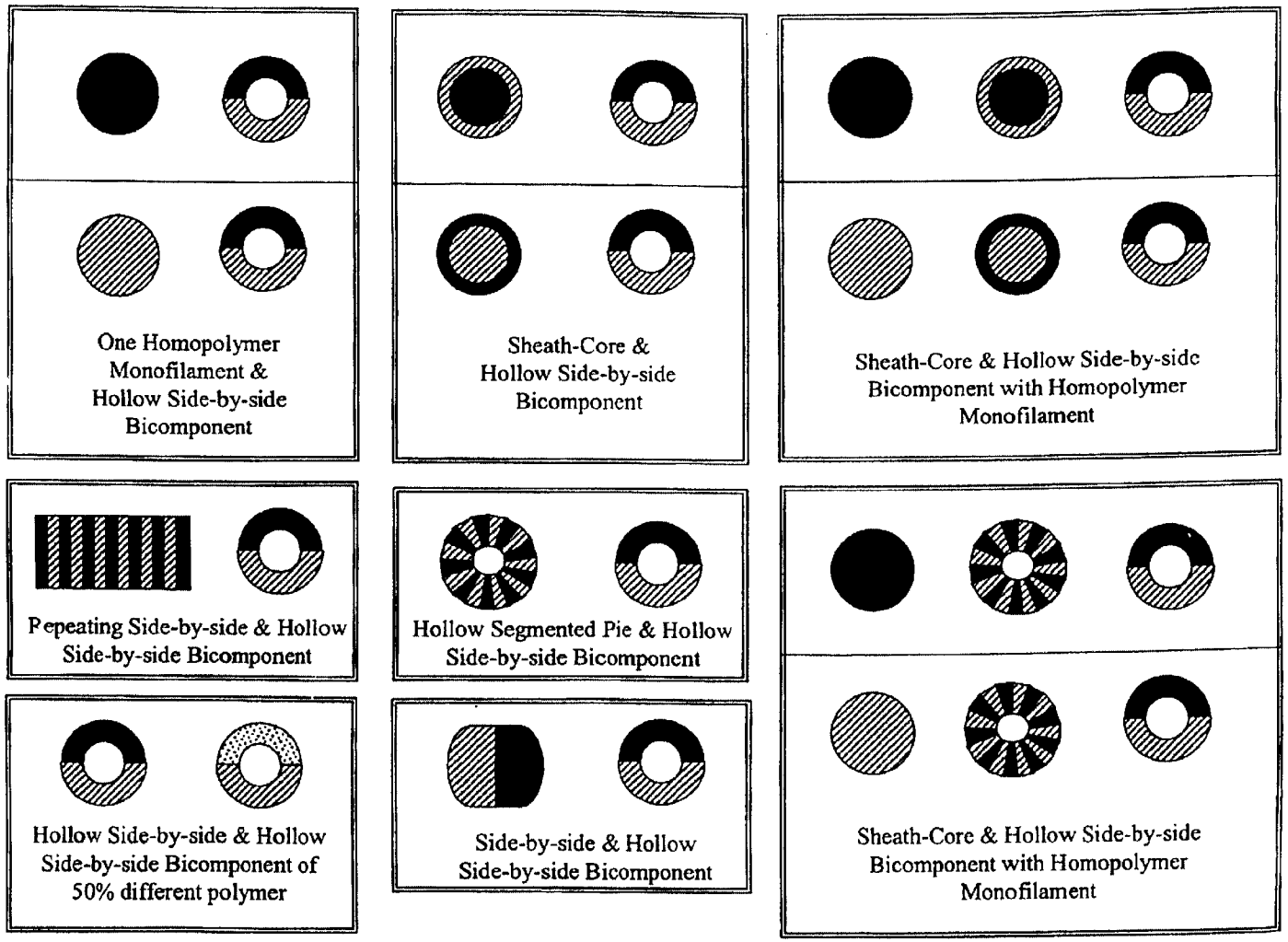
Figure 2C:
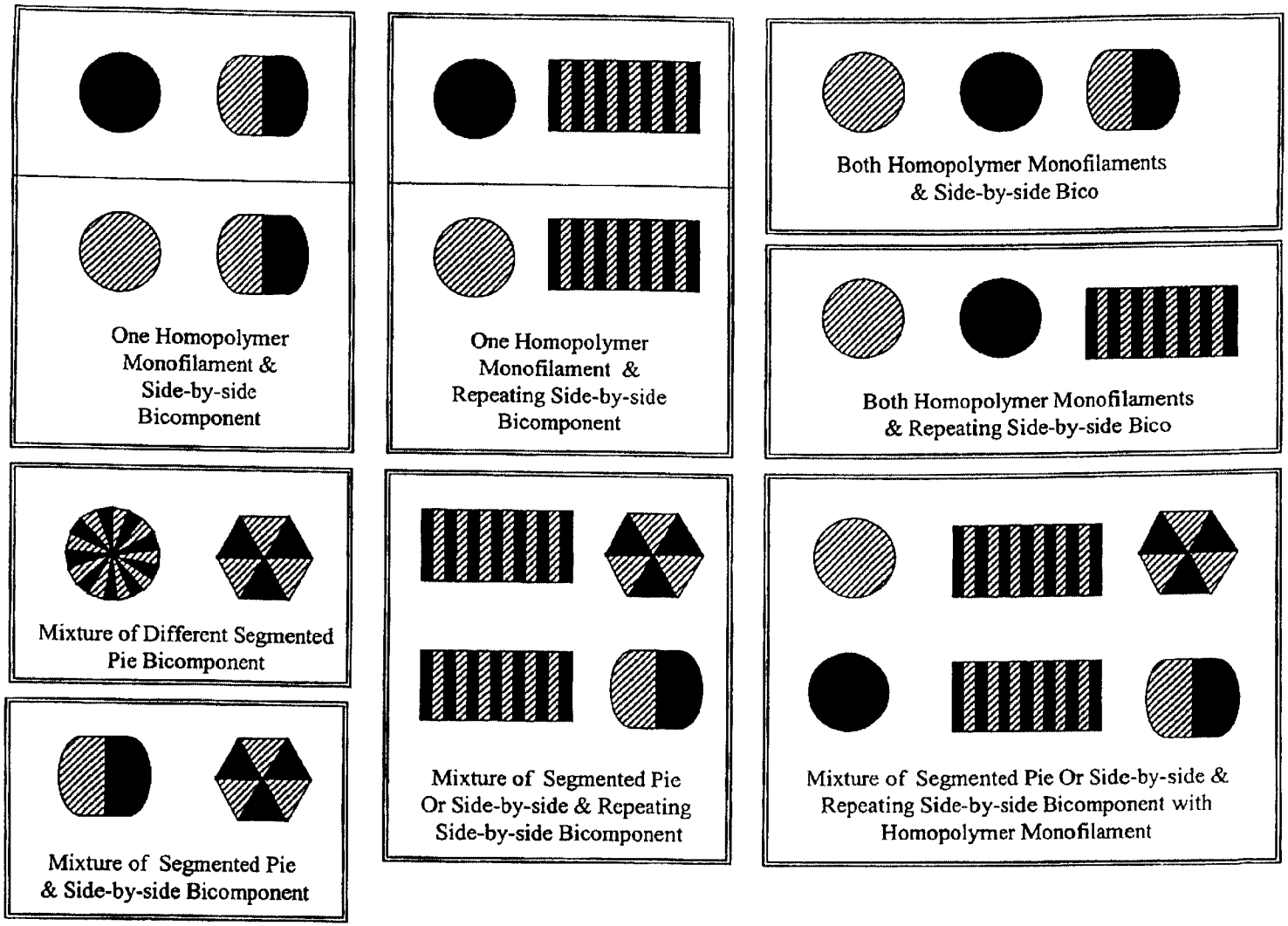

The appended illustrations, designated FIGS. 2*a*, 2*b*, and 2*c*, illustrate various filament profiles contemplated by the present invention. As will be observed, it is contemplated that by providing a plurality of polymer extruders for supplying polymer streams of at least two different polymers, a spinneret assembly which receives the polymer streams can be configured for extruding substantially continuous filaments from the polymer compositions, wherein the filaments can be of differing configurations and/or polymer compositions. The present invention contemplates formation of filaments including at least some filaments as bi-component filaments including at least two of the polymer compositions, while other ones of the filaments are formed from a single one of the polymer compositions. These are illustrated in the appended drawings, wherein one filament of a homopolymer, and an associated bi- or multi-component filament are illustrated. It is also contemplated that some of the filaments can be configured as side-by-side bi-component filaments, each including at least two of the polymer compositions, while other ones of the filaments are segmented pie bi-component filaments. Additionally, it is within the purview of the present invention that side-by-side or segmented pie bi-component filaments be of a hollow configuration.

In a presently preferred practice of the present invention, thermal bonding of the filaments of the filament web is contemplated. Such thermal bonding may comprise thermal point bond calendering, or through-air bonding, as known in the art.

While thermal bonding of the filament web is presently preferred, alternative bonding techniques, such as hydroentanglement, use of a binder composition, and needle punching may be employed. Other bonding techniques as are known to those skilled in the art may alternatively be used.

The present invention contemplates production of a nonwoven fabric from a web of essentially continuous filaments wherein the filaments are in a controlled or statistical distribution of more than one type of homopolymer filament, wherein at least one of the homopolymers has a crystalline melting point at least 51° C. lower than the other homopolymer(s), thus promoting thermal bonding. The present invention also contemplates production of a nonwoven fabric from a web of essentially continuous filaments, wherein the filaments are in controlled distribution of homopolymer filaments and bi-component filaments, where at least one component of the plural component filaments has a crystalline melting point at least 51° C. lower than the other homopolymer(s). It is contemplated that the polymers may be selected from the group consisting of polyolefins, polyesters, polyamides, and copolymers or terpolymers of the same. In practice, the ratio of distribution of the plural component filaments, or lower melting point filaments, to the higher melting point homopolymer is in the range of 5/95 to 95/5.

Distribution of the plural component filaments may be uniform, scattered, or a selected zonal concentration across the face of the spinneret.

Practice of the present invention permits formation of nonwoven fabrics from continuous filament webs which exhibit grab tensile strength that is significantly higher than that of a similar web of only one type of filament. Depending upon polymer selection, filament configuration, and bonding temperatures, grab tensile strength may be at least 20% greater than a similar web of only one type of filament.

In an current embodiment of the present invention, a filament web has been produced comprising a distribution of polyethylene terephthalate (PET) filaments and co-PET filaments. The filaments distribution ratio is 10% co-PET and 90% PET. These spunbond web examples were made in basis weights of 20, 28, and 51 grams per square meter, and were thermally point-bonded. A quantity of lightly bonded web was produced, then further processed by application of through-air bonding. The accompanying Tables disclose test data generated from testing of these various samples. EMPACT is a spunbond PET product commercially available from Polymer Group Incorporate, a Delaware company. This product is made from the same PET resin (Eastman FH61C) as the tested samples, but contains no co-PET. The data shown for the EMPACT product is representative of commercially produced material.

U.S. Pat. No. 5,466,410, to Hills, hereby incorporated by reference, illustrates an apparatus of the type which can be employed for practice of the present method. This patent illustrates a spinneret assembly in the form of a spin pack assembly 10, shown in appended FIG. 1, including a spinneret plate 15 defining a plurality of orifices through which molten polymeric composition is extruded. Notably, the spin pack assembly 10 includes polymer distribution components which are formed by photoengraving, thus promoting economical manufacturing use of the spin pack assembly.

From the foregoing, numerous modifications and variations can be effected without departing from the true spirit and scope of the novel concept of the present invention. It is to be understood that no limitation with respect to the specific embodiments disclosed herein is intended or should be inferred. The disclosure is intended to cover, by the appended claims, all such modifications as fall within the scope of the claims.

TABLE 1

| SAMPLE IDENTIFICATION | BASIS WEIGHT (gsm) | BULK (mm) | MULLEN BURST (psi) | MD GRAB TENSILE (g/cm) | MD GRAB ELONGATION (%) | CD GRAB TENSILE (g/cm) | CD GRAB ELONGATION (%) | ND TRAP (g) |
|---|---|---|---|---|---|---|---|---|
| 20 gsm F/D 99/10 | 20.35 | 0.10 | 16.23 | 1527.66 | 20.49 | 470.65 | 60.20 | 4683.42 |
| 28 gsm F/D 90/10 | 30.15 | 0.14 | 22.66 | 2352.14 | 21.72 | 1086.05 | 44.11 | 5749.38 |
| 51 gsm F/D 90/10 | 45.40 | 0.22 | 29.01 | 4506.59 | 20.31 | 2485.27 | 31.67 | 6580.19 |
| 17 gsm S/C 20/80 | 19.01 | 0.11 | 16.34 | 1935.54 | 25.98 | 448.98 | 62.01 | 5919.48 |
| 28 gsm S/C 20/80 | 27.25 | 0.14 | 25.94 | 4113.23 | 31.44 | 1768.24 | 56.52 | 5845.77 |
| 51 gsm S/C 20/80 | 51.53 | 0.25 | 53.96 | 8085.28 | 30.71 | 4204.81 | 50.53 | 8799.84 |
| 23 gsm S/S 70/30 | 22.48 | 0.12 | 16.48 | 1705.91 | 27.48 | 809.51 | 64.12 | 6123.60 |
| 34 gsm S/S 70/30 | 30.84 | 0.16 | 23.88 | 3280.49 | 32.40 | 1173.61 | 47.27 | 6571.53 |

| SAMPLE IDENTI-FICATION | CD TRAP (g) | MD HANDLEOMETER (g) | CD HANDLEOMETER (g) | AIR PERMEABILITY (cfm/f2) | MD SHRINKAGE (%) | CD SHRINKAGE (%) |
|---|---|---|---|---|---|---|
| 20 gsm F/D 99/10 | 4683.42 | 2.29 | 17.33 | 564.10 | 21.51 | 6.00 |
| 28 gsm F/D 90/10 | 5017.95 | 10.08 | 41.58 | 443.34 | 11.17 | 3.30 |
| 51 gsm F/D 90/10 | 5857.11 | 78.05 | 159.25 | 185.68 | 5.51 | 0.96 |
| 17 gsm S/C 20/80 | 4706.10 | 1.98 | 23.13 | 619.60 | 8.46 | −14.42 |
| 28 gsm S/C 20/80 | 5403.51 | 11.98 | 79.13 | 334.15 | 7.73 | −7.28 |
| 51 gsm S/C 20/80 | 6452.46 | 96.28 | 161.68 | 202.11 | 6.50 | −4.33 |
| 23 gsm S/S 70/30 | 5131.35 | 4.35 | 30.14 | 562.46 | 6.99 | −8.02 |
| 34 gsm S/S 70/30 | 5227.74 | 15.39 | 74.15 | 364.89 | 6.99 | −6.67 |

TABLE 2

| | SAMPLE: 926FD@28GSM 221C 137PPM | | | | | | | |
|---|---|---|---|---|---|---|---|---|
| Thru Air Sample ID | BASIS WEIGHT (gsm) | BULK (mm) | MD STRIP TENSILE (g/cm) | MD STRIP ELONGATION (%) | CD STRIP TENSILE (g/cm) | CD STRIP ELONGATION (%) | MD GRAB TENSILE (g) | MD GRAB ELONGATION (%) |
| 0.28 gsm 221C 137FPI | 28.0 | 0.19 | 1226 | 18.1 | 468 | 33.7 | 7038 | 21.0 |
| 0.51 gsm 216C 137FPI | 60.0 | 0.28 | 2911 | 21.7 | 1068 | 33.0 | 16702 | 26.0 |
| 0.28 gsm 210C 137FPI | 30.8 | 0.21 | 1680 | 16.3 | 480 | 38.0 | 8814 | 22.0 |
| S 34 gsm 210C 137FPI | 34.7 | 0.21 | 1942 | 21.6 | 620 | 60.9 | 8502 | 24.0 |

TABLE 2-continued

| Thru Air Sample ID | CD GRAB TENSILE (g) | CD GRAB ELONGATION (%) | MD TRAP TEAR (g) | CD TRAP TEAR (g) | MULLEN BURST (psi) | FRAZIER AIR PERM (cfm/sqfr) | MD SHRINK-AGE (%) | CD SHRINK-AGE (%) |
|---|---|---|---|---|---|---|---|---|
| SAMPLE: 926FD@28GSM 221C 137PPM | | | | | | | | |
| 0.28 gsm 221C 137FPI | 3694 | 69.0 | 1667 | 888 | 20.3 | 570 | 1.0 | 0.3 |
| 0.51 gsm 216C 137FPI | 7988 | 38.0 | 3150 | 1522 | 42.2 | 267 | 1.3 | 0.7 |
| 0.28 gsm 210C 137FPI | 4200 | 49.0 | 1816 | 871 | 20.8 | 608 | 1.9 | −0.2 |
| S 34 gsm 210C 137FPI | 1614 | 55.0 | 2107 | 1046 | 21.9 | 471 | 1.4 | −0.4 |

TABLE 3

| SAMPLE IDENTIFICATION | MD HANDLEOMETER (g) | CD HANDLEOMETER (g) |
|---|---|---|
| SC, 28 gsm, 210° C., 137 FPM, ≈ O.C. | 38.76 | 118.88 |
| # 26 FD, 28 gsm, 221° C., 137 FPM | 29.99 | 58.64 |
| FD, 51 gsm, 216° C., 137 FPM, ≈ O.C. | 83.65 | 160.45 |
| # 16 SS, 34 gsm, 210° C., 137 FPM, ≈ O.C. | 39.31 | 124.44 |
| # 2 FB, 17 gsm, 210° C., 91 FPM | 15.88 | 34.06 |
| FB, 0.50 osy, CONTROL | 7.23 | 13.74 |
| FB, 1.25 osy, CONTROL | 94.39 | 154.41 |
| # 5 FB, 1.25 osy, 210° C., 91 FPM | 159.45 | 163.95 |
| FB, 2.50 osy, CONTROL | 164.07 | 164.20 |
| # 10 FB, 2.50 osy, 220° C., 91 FPM | 164.03 | 164.10 |

*numbers in excess of 163.00 indicate samples exceed machine capabilities

TABLE 4

| | 20 gsm F/D 90/10 FIBER DIAMETER (microns) | 20 gsm F/D 90/10 DENIER | 17 gsm S/C 20/80 FIBER DIAMETER (microns) | 17 gsm S/C 20/80 DENIER |
|---|---|---|---|---|
| 1 | 13.88 | 1.24 | 12.16 | 0.95 |
| 2 | 13.87 | 1.24 | 12.33 | 0.98 |
| 3 | 13.47 | 1.17 | 12.57 | 1.02 |
| 4 | 13.33 | 1.14 | 12.83 | 1.06 |
| 5 | 13.71 | 1.21 | 12.12 | 0.94 |
| 6 | 13.32 | 1.14 | 12.89 | 1.07 |
| 7 | 13.98 | 1.26 | 12.96 | 1.08 |
| 8 | 13.07 | 1.10 | 12.46 | 1.00 |
| 9 | 13.59 | 1.19 | 12.98 | 1.08 |
| 10 | 13.76 | 1.22 | 12.34 | 0.98 |
| 11 | 13.08 | 1.10 | 12.71 | 1.04 |
| 12 | 14.00 | 1.26 | 12.90 | 1.07 |
| 13 | 12.75 | 1.05 | 12.17 | 0.95 |
| 14 | 13.64 | 1.20 | 12.24 | 0.96 |
| 15 | 12.86 | 1.06 | 12.91 | 1.07 |
| 16 | 13.21 | 1.12 | 12.14 | 0.95 |

TABLE 4-continued

| | 20 gsm F/D 90/10 FIBER DIAMETER (microns) | 20 gsm F/D 90/10 DENIER | 17 gsm S/C 20/80 FIBER DIAMETER (microns) | 17 gsm S/C 20/80 DENIER |
|---|---|---|---|---|
| 17 | 13.57 | 1.18 | 12.63 | 1.03 |
| 18 | 13.90 | 1.24 | 12.78 | 1.05 |
| 19 | 13.47 | 1.17 | 12.96 | 1.08 |
| 20 | 13.02 | 1.09 | 12.21 | 0.96 |
| 21 | 13.03 | 1.09 | 12.49 | 1.00 |
| 22 | 13.16 | 1.11 | 12.07 | 0.94 |
| 23 | 12.83 | 1.06 | 12.62 | 1.02 |
| 24 | 13.10 | 1.10 | 12.81 | 1.05 |
| 25 | 12.96 | 1.08 | 12.09 | 0.94 |
| AVG | 13.38 | 1.15 | 12.53 | 1.01 |
| ST DEV | 0.39 | 0.07 | 0.32 | 0.05 |

TABLE 5

| 23 gsm S/S 70/30 FIBER DIAMETER (microns) | 23 gsm S/S 70/30 DENIER |
|---|---|
| 12.27 | 0.97 |
| 12.40 | 0.99 |
| 11.96 | 0.92 |
| 12.68 | 1.03 |
| 12.49 | 1.00 |
| 12.37 | 0.98 |
| 12.26 | 0.97 |
| 12.81 | 1.05 |
| 12.74 | 1.04 |
| 12.49 | 1.00 |
| 12.88 | 1.07 |
| 12.59 | 1.02 |
| 12.31 | 0.97 |
| 12.67 | 1.03 |
| 12.54 | 1.01 |
| 12.91 | 1.07 |
| 12.08 | 0.94 |
| 12.49 | 1.00 |
| 12.63 | 1.03 |
| 12.74 | 1.04 |
| 12.59 | 1.02 |
| 12.68 | 1.03 |
| 12.43 | 0.99 |
| 12.74 | 1.04 |
| 12.86 | 1.06 |
| 12.54 | 1.01 |
| 0.24 | 0.04 |

TABLE 6

| SAMPLE IDENTIFICATION | Bonding Technology | BASIS WEIGHT (gsm) | BULK (mm) | MULLEN BURST (psl) | MD GRAB TENSILE (g/cm) | MD GRAB ELON-GATION (%) | CD GRAB TENSILE (g/cm) | CD GRAB ELON-GATION (%) | MD TRAP (g) | CD TRAP (g) | MD HANDLE-OMETER (g) | CD HANDLE-OMETER (g) | AIR PERMEA-BILITY (cfm/12) | MD SHRINK-AGE (%) | CD SHRINK-AGE (%) | Denler dpf |
|---|---|---|---|---|---|---|---|---|---|---|---|---|---|---|---|---|
| 17 gsm EMPACT | PB | 18 | 0.15 | 16.54 | 1411 | | 944 | | 1387 | 933 | 24 | 63 | 673 | 4.57 | 1.93 | 2 |
| 17 gsm S/C 20/80 | PB | 19.01 | 0.11 | 18.34 | 5969 | 25.20 | 2338 | 84.20 | 1650 | 780 | 198 | 23.13 | 620 | 8.46 | −14.42 | 1.49 |
| 20 gsm FD 90/10 | PB | 20.35 | 0.10 | 18.23 | 4299 | 16.80 | 1909 | 50.90 | 1670 | 730 | 2.29 | 17.33 | 564 | 21.51 | 6.00 | 17 |
| 23 gsm S/S 70/30 | PB | 22.48 | 0.12 | 16.48 | 8575 | 29.20 | 3098 | 68.20 | 1880 | 590 | 4.35 | 30.14 | 562 | 6.99 | −8.02 | 1.49 |
| 25 gsm EMPACT | PB | 26.85 | 0.20 | 22.77 | 2395 | | 1688 | | 2279 | 1791 | | | 621 | 3.15 | 1.85 | 2 |
| 28 gsm PB FD 90/10 | PB | 30.15 | 0.14 | 22.68 | 8018 | 22.10 | 3724 | 39.00 | 1800 | 820 | 10.08 | 41.58 | 443 | 11.17 | 3.30 | 1.7 |
| 28 gsm TAB F 90/10 | TAB | 28.00 | 0.19 | 20.30 | 7133 | 19.50 | 3473 | 39.40 | 700 | 300 | 29.99 | 58.84 | 570 | 1.00 | 0.30 | 1.7 |
| 28 gsm PB S/C 20/80 | PB | 27.25 | 0.14 | 25.94 | 11426 | 28.80 | 5478 | 53.00 | 2680 | 1340 | 11.68 | 79.13 | 334 | 7.73 | −7.28 | 1.49 |
| 28 gsm TAB S/C 20/80 | TAB | 30.60 | 0.21 | 20.80 | 9282 | 17.70 | 4147 | 39.70 | 1520 | 1020 | 38.76 | 118.88 | 608 | 1.90 | −0.20 | 1.49 |
| 34 gsm EMPACT | PB | 35.62 | 0.24 | 28.24 | 3374 | | 2473 | | 2989 | 2144 | | | 457 | 2.58 | 0.91 | 2 |
| 34 gsm PB S/S 70/30 | PB | 30.84 | 0.16 | 23.88 | 9714 | 35.40 | 4603 | 50.80 | 2960 | 1320 | 15.39 | 74.15 | 385 | 8.99 | −6.67 | 1.49 |
| 34 gsm TAB S/S 70/30 | TAB | 34.7 | 0.21 | 21.9 | 9692 | 19.9 | 4377 | 65.3 | 1660 | 844 | 39.31 | 124.44 | 471 | 14 | −0.4 | 1.49 |
| 51 gsm EMPACT | PB | 53.81 | 0.34 | 36.92 | 4675 | | 3708 | | 3977 | 2897 | | | 259 | 7.03 | −1.82 | 2 |
| 51 gsm FD 90/10 | PB | 45.40 | 0.22 | 29.01 | 15468 | 22.30 | 7877 | 33.30 | 2980 | 1730 | 78.05 | 159.25 | 186 | 5.51 | 0.96 | 1.7 |
| 51 gsm FD 90/10 | TAB | 50.00 | 0.26 | 42.20 | 15473 | 22.00 | 8373 | 35.80 | 2800 | 1430 | 83.65 | 160.45 | 267 | 1.30 | 0.70 | 1.7 |
| 51 gsm S/C 20/80 | PB | 51.53 | 0.25 | 53.96 | 22732 | 29.10 | 11158 | 48.60 | 5400 | 2270 | 96.28 | 161.58 | 202 | 8 | −4.33 | 1.49 |

TABLE 7

| Process Variable | Comparison Against EMPACT Product | | | |
|---|---|---|---|---|
| | Grab Strength | Tear Strength | CD Stiffness | Mullen Burst |
| Point Bonded Sheath/Core | MD > 300% Increase CD > 250% Increase | MD No Change CD No Change | >250% Increase | 51 gsm >45% Increase |
| Point Bonded Filament Dist | MD > 200% Increase CD > 100% Increase | MD No Change CD No Change | >170% Increase | 51 gsm >20% Decrease |
| Point Bonded Side/Side | MD > 180% Increase CD > 80% Increase | MD No Change CD No Change | >300% Increase | 34 gsm 20% Decrease |

TABLE 7-continued

| Process Variable | Comparison Against EMPACT Product | | | |
|---|---|---|---|---|
| | Grab Strength | Tear Strength | CD Stiffness | Mullen Burst |
| Thru-air Bonded Sheath/Core | MD > 175% Increase CD > 70% Increase | MD > 70% Decrease CD > 90% Decrease | No Data But Significant Change | 28 gsm −20% Decrease |
| Thru-air Bonded Filament Dist | MD > 200% Increase CD > 100% Increase | MD > 40% Decrease CD > 100% Decrease | No Data But Significant Change | -Equivalent |
| Thru-air Bonded Side/Side | MD > 180% Increase CD > 75% Increase | MD > 80% Decrease CD > 140% Decrease | No Data But Significant Change | 34 gsm 28% Decrease |

This chart shows the generic trends of the data.

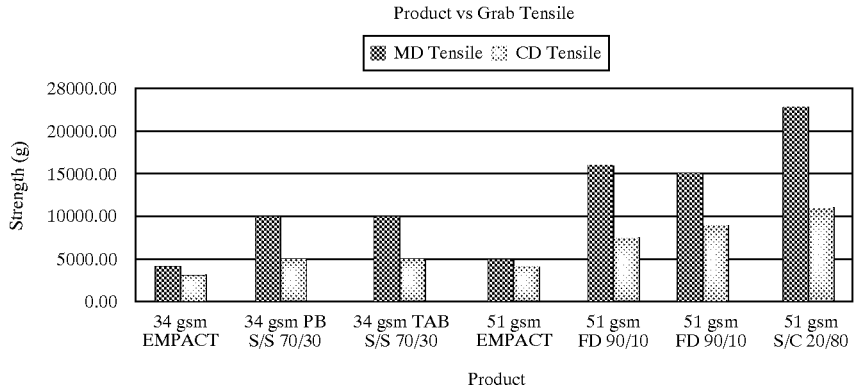

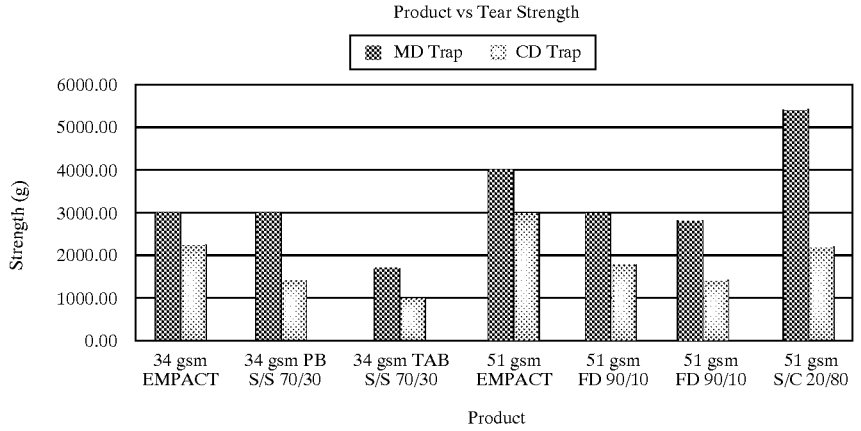

-continued
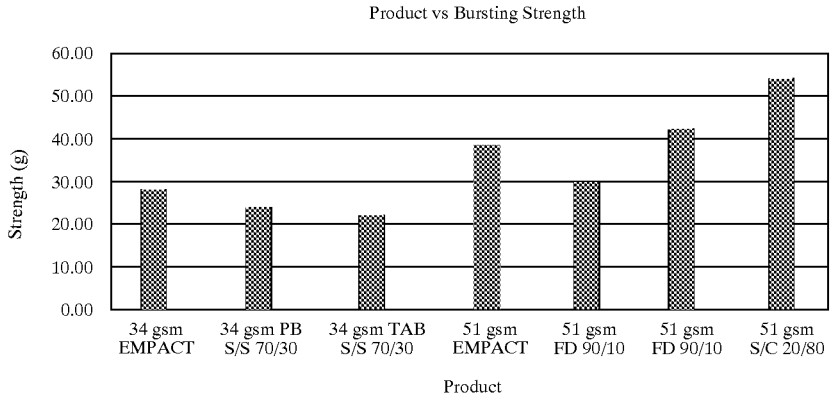
TABLE 9
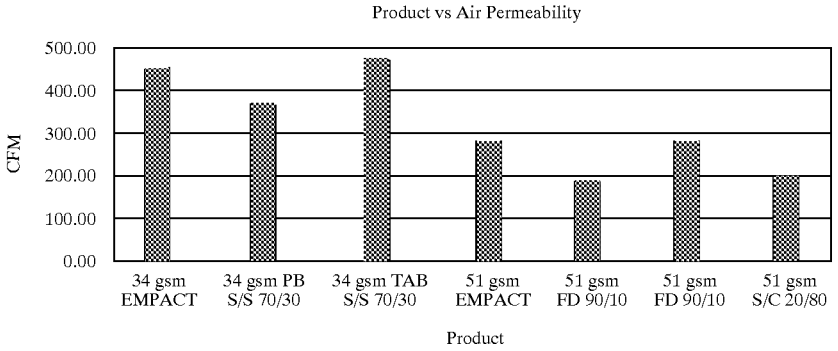
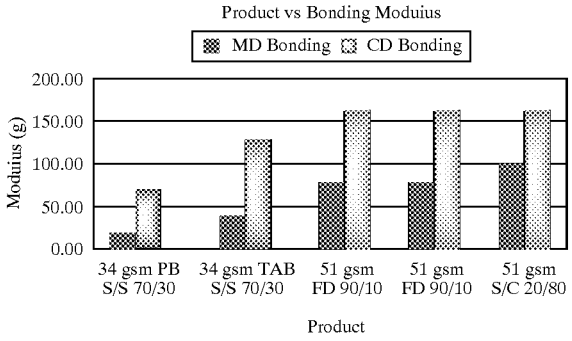

TABLE 9-continued
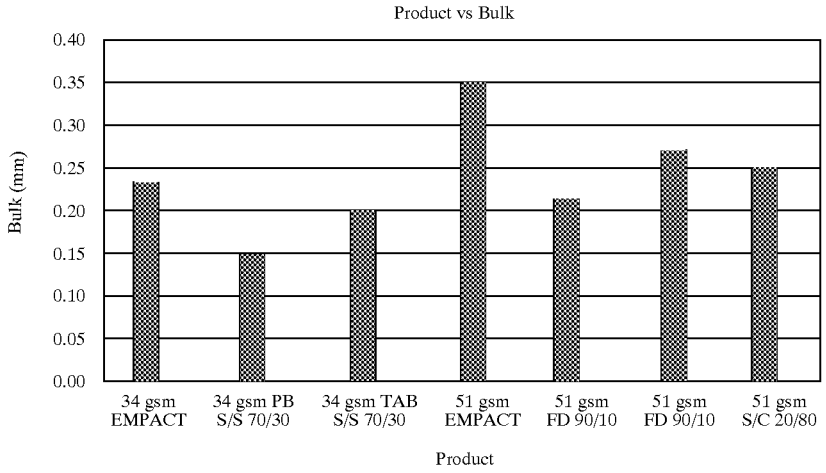
TABLE 10
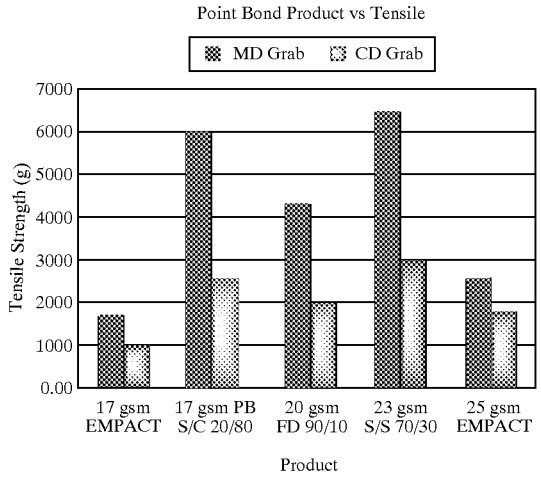
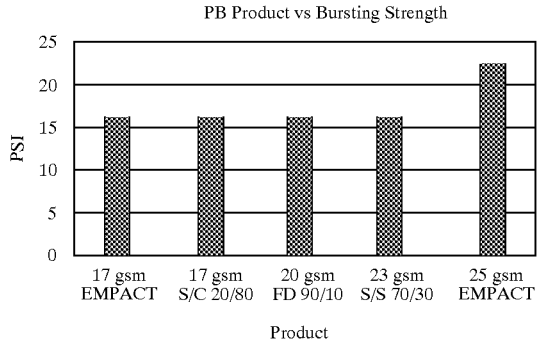
TABLE 10-continued
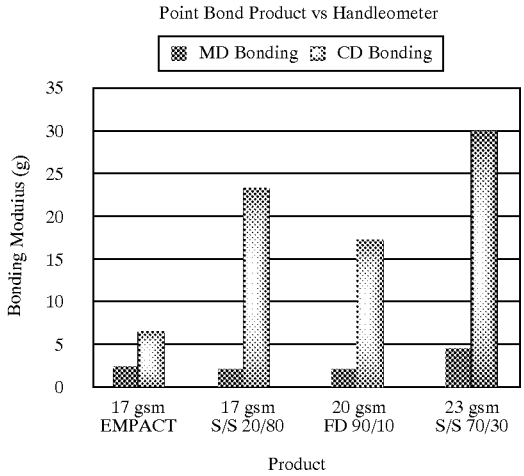
TABLE 11
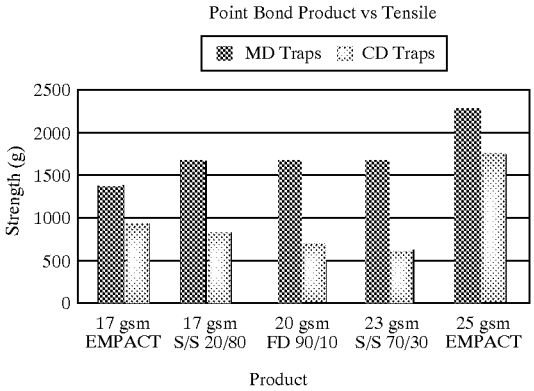

TABLE 11-continued
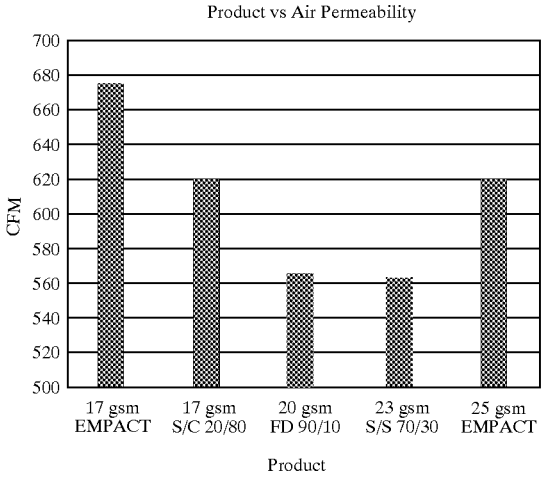
TABLE 11-continued
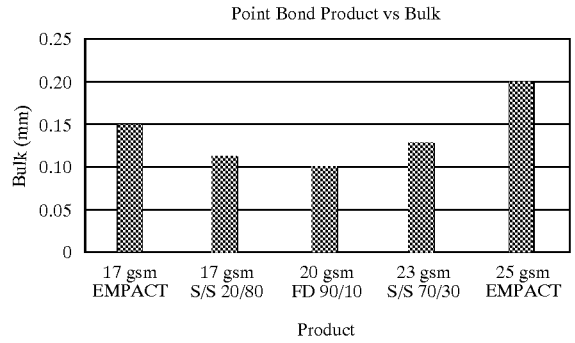
TABLE 12
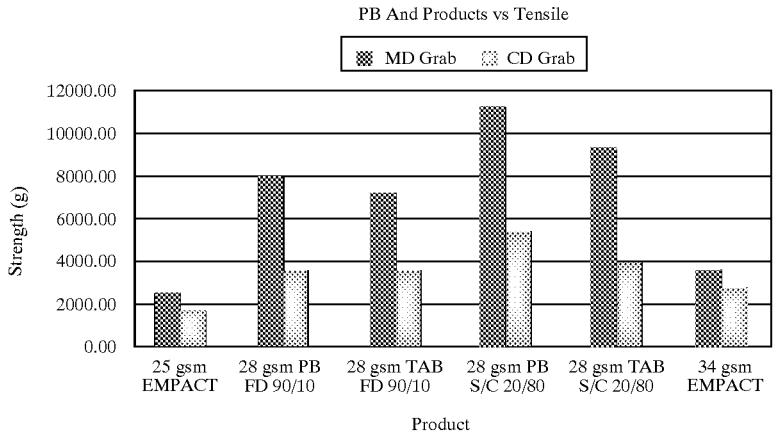
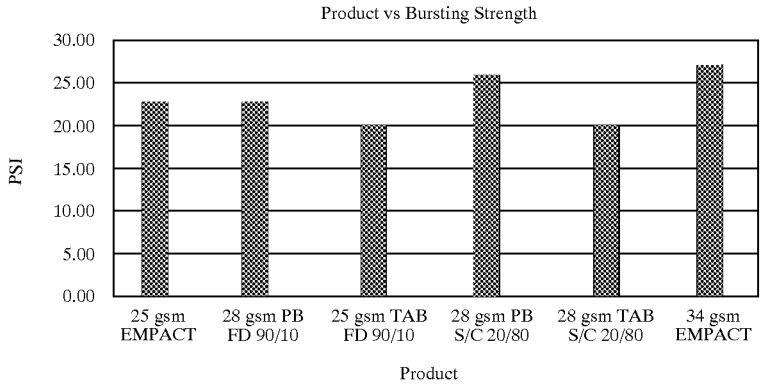

TABLE 12-continued
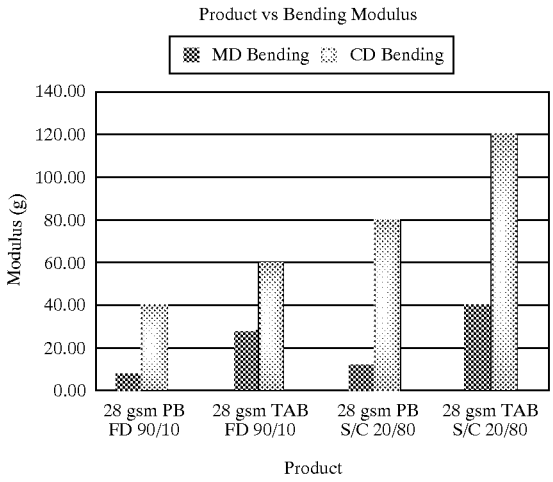
TABLE 13
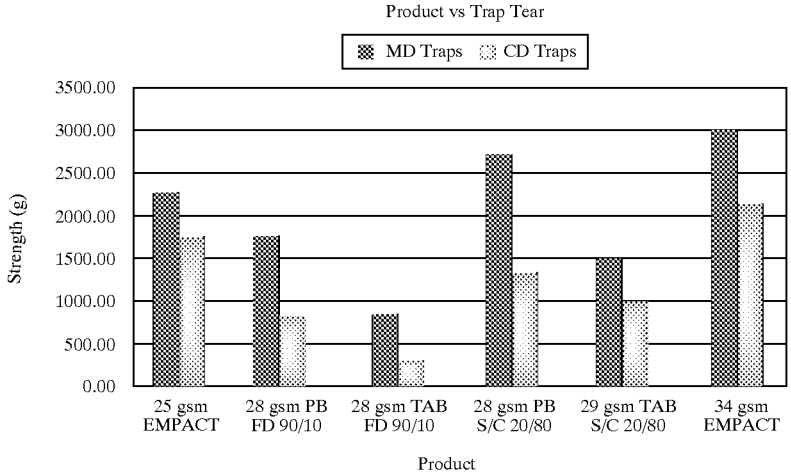
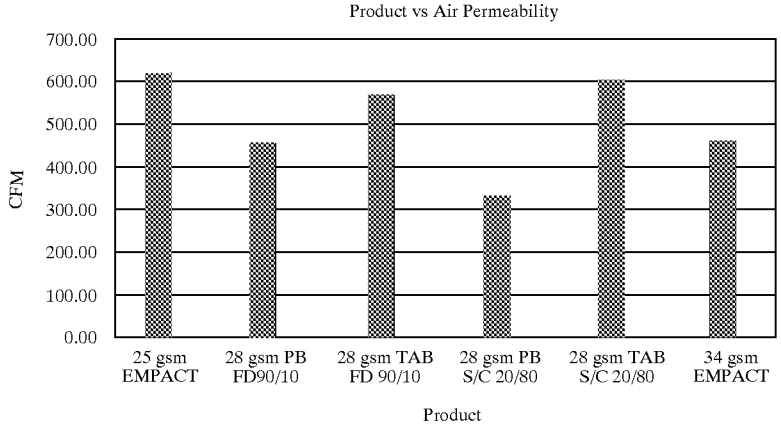

TABLE 13-continued

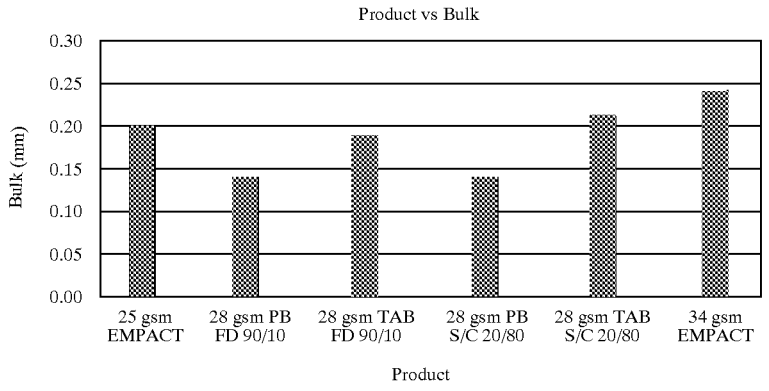

What is claimed is:

1. A method of making a substantially continuous filament web, comprising the steps of:

providing a plurality of polymer extruders for supplying polymer streams of at least two different polymer compositions having differing melting points;

providing a single spinneret assembly for receiving said polymer streams of at least two different polymer compositions, said single spinneret assembly including a plurality of orifices from which said polymer streams are extruded for formation substantially continuous filaments formed from said polymer compositions, wherein at least some of said substantially continuous filaments are formed as polymer filaments from a single one of said polymer compositions and other ones of said substantially continuous filaments are formed as polymer filaments from: a single different one of said polymer compositions, or plural ones of said polymer compositions, and thermal bonding said substantially continuous filaments to form said web, wherein the distribution of at least one of said polymer compositions within said spinneret assembly is selected to optimize selected physical characteristics of said web.

2. A method of making a substantially continuous filament-web in accordance with claim 1, wherein:

said thermal bonding step comprises thermal point bond calendering.

3. A method of making a substantially continuous filament-web in accordance with claim 1, wherein:

said thermal bonding step comprises through-air bonding.

4. A method of making a substantially continuous filament-web in accordance with claim 1, wherein:

said formation of said filaments includes forming at least some of said filaments as bi-component filaments each including at least two of said polymer compositions.

5. A method of making a substantially continuous filament-web in accordance with claim 4, wherein:

said bi-component filaments comprise sheath-core bi-component filaments.

6. A method of making a substantially continuous filament-web in accordance with claim 4, wherein:

said bi-component filaments comprise segmented pie bi-component filaments.

7. A method of making a substantially continuous filament-web in accordance with claim 4, wherein:

said bi-component filaments comprise side-by-side bi-component filaments.

8. A method of making a substantially continuous filament-web in accordance with claim 1, wherein:

said formation of said filaments includes forming at least some of said filaments as side-by-side bi-component filaments each including at least two of said polymer compositions, and other ones of said filaments as segmented pie bi-component filaments.

9. A method of making a substantially continuous filament-web in accordance with claim 1, wherein said formation of said filaments includes forming at least some of said filaments as hollow bi-component filaments.

* * * * *